United States Patent [19]

Henrich

[11] 4,338,651

[45] Jul. 6, 1982

[54] DUAL COIL DRIVER

[75] Inventor: Robert S. Henrich, Farmington Hills, Mich.

[73] Assignee: The Bendix Corporation, Southfield, Mich.

[21] Appl. No.: 193,333

[22] Filed: Oct. 1, 1980

[51] Int. Cl.[3] ..... H01H 47/04

[52] U.S. Cl. ..... 361/154; 123/490

[58] Field of Search ..... 361/154; 123/32 EA, 123/32 EF, 32 EG

[56] References Cited

U.S. PATENT DOCUMENTS

| | | | |
|---|---|---|---|
| 3,018,419 | 1/1962 | Bonn | 361/154 |
| 3,356,910 | 12/1967 | Bushnell | 361/154 |
| 3,700,985 | 10/1972 | Applequist | 361/154 |
| 3,786,344 | 1/1974 | Davis et al. | 323/267 |
| 4,040,397 | 8/1977 | Leichle | 123/490 |
| 4,114,184 | 9/1978 | Stampfli | 361/154 |
| 4,227,231 | 10/1980 | Hansen et al. | 361/154 |

FOREIGN PATENT DOCUMENTS

| | | | |
|---|---|---|---|
| 739593 | 7/1966 | Canada | 361/154 |

*Primary Examiner*—J. D. Miller
*Assistant Examiner*—L. C. Schroeder
*Attorney, Agent, or Firm*—Markell Seitzman; Russel C. Wells

[57] ABSTRACT

A driver circuit, having boost and hold modes of operation, for a solenoid having a high and a low impedance coil wherein the coils are so situated such that their respective magnetic fields are additive and wherein the driver circuit is responsive to input metering pulse width signals and includes means for modifying the duration of each pulse width signal to generate a boost pulse signal to excite the low impedance coil in correspondence with the variations in the battery voltage. The driver circuit further includes means for permitting the current flowing through the low impedance coil into flow into a high impedance coil and means for regulating the value of current flowing therethrough at a determinable value. The driver circuit further includes means for reducing the current droop occurring upon the transition from the boost mode of operation to the hold mode of operation.

22 Claims, 6 Drawing Figures

DUAL COIL DRIVER

BACKGROUND AND SUMMARY OF THE INVENTION

This invention relates to an electronic driver circuit for controlling the operation of a solenoid having at least two coils and more particularly to controlling the operation of a fuel injector for a diesel engine.

Prior driver circuits previously utilized for the control of diesel fuel injectors have been large and have displayed power dissipation which is excessive. The most difficult aspect of developing a driver which meets the need of diesel injectors, that have large flow capacity, is the high power and high voltage required for rapid operation. To achieve rapid response and to minimize the delay and motion time of the solenoid movement many driver circuits have used a capacitive boost circuit which contributes to the driver circuits large size and high costs.

By utilizing a solenoid having two coils, the present driver reduces heat dissipation. The present invention provides a fast and repeatable response and displays reduced power and size requirements.

As described in detailed below, the invention is directed to a driver circuit for a solenoid actuated fuel injection valve which uses a single solenoid having two coils, a first or pull-in coil to open the injector valve and a second or hold coil to maintain the movable plunger of the solenoid in an open position. In response to pulse width signals generated by an electronic control unit or ECU, a boost current pulse is supplied to the driver coil for opening the injector valve. The boost current is not regulated during the boost mode, however, the duration or pulse width of the boost current pulse is controlled as a function of the battery voltage in order to compensate for variations in battery voltage.

An advantage of the present system is that it is capable of operating at battery voltages as low as 5.3 volts. In addition, the driver contains circuitry which controls the undershoot or current droop which is inherent in solenoid driver circuits having boost and hold modes of operation and includes circuitry to inhibit solenoid operation when the input metering pulse transmitted from an electronic control unit is ill conditioned.

Many other features and advantages of the present invention will be clear from the following detailed description of drawings.

DETAILED DESCRIPTION OF THE DRAWINGS

Figure 1:
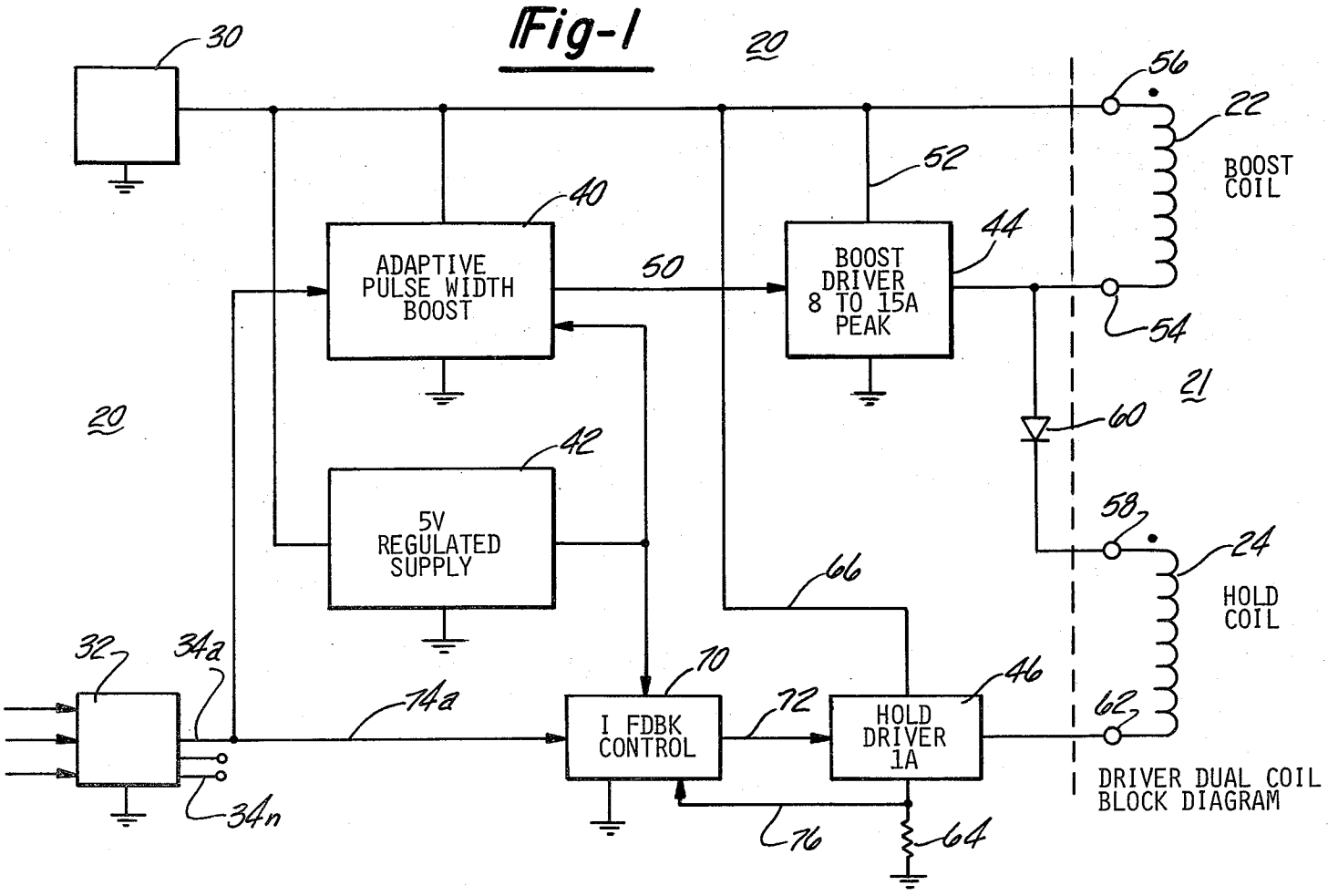
FIG. 1 is a block diagram of a solenoid driver circuit.

Reference is now made to FIG. 1 which illustrates a schematic block diagram of a driver circuit 20 for a solenoid 21 having a first or boost coil 22 and a second or hold coil 24. The solenoid 21 may be of the type incorporated into a fuel injector for a fuel injected engine and the driver circuit 20 of the type having two modes of operation, i.e. a boost mode and a hold mode. The coils 22 and 24 are connected such that when activated their individual magnetic fields are additive. The driver circuit 20 comprises a voltage source or battery 30 and an electronic control unit or ECU 32 of a known variety wherein the ECU 32 is adapted to receive input signals determinative of the state of the engine. The input signals may include signals such as: engine speed, manifold pressure, exhaust gas constituency etc. The output of the ECU 32 is a time series of variable duration metering pulses directed to each solenoid 21. These metering pulses are transmitted on lines 34*a* through 34*n* to an adaptive pulse width boost circuit 40 contained within each driver circuit 20. Circuit 40 is connected to the voltage source 30 as well as to a regulated power supply 42. The regulated power supply 42 receives power from the voltage source 30 and generates a regulated output voltage, such as five (5) volts, which comports with the requirements of many integrated circuits. The driver circuit 20 further includes a boost driver circuit 44 and a hold driver circuit 46. The boost driver circuit 44 receives a control signal on line 50 from its associated adaptive pulse width boost circuit 40 and receives power via line 52 from the voltage source 30. The output of the boost driver circuit 44 is connected to terminal 54 of the boost coil 22. The other terminal 56 of the boost coil 22 is connected to the voltage source 30. The terminal 54 is connected to terminal 58 of the hold coil 24 through an intermediate or blocking diode 60. The purpose of diode 60 is to isolate each coil and its respective driver circuit during the boost mode or phase of operation. The other terminal 62 of the hold coil 24 is connected to the output of the hold driver circuit 46. In addition, the hold driver circuit 46 is connected to a sense resistor 64. The hold driver circuit 46 receives input power via line 66 from the voltage source 30 and receives a control signal from a feedback current control circuit 70 via line 72. The feedback current control circuit 70 is adapted to receive one of the metering signals generated by the electronic control unit 32 via line 74 and is further adapted to receive power from the regulated power supply 42. A closed feedback loop is completed by sensing the voltage drop across the sense resistor 64 and by feeding this voltage back to the feedback current control circuit 70 via line 76.

The operation of the circuit illustrated in FIG. 1 is as follows. Metering signals are periodically generated by the electronic control unit 32 and are transmitted to each respective boost circuit 40 and the feedback current control circuit 70. The response to these metering signals, the boost phase of operation is begun wherein current is permitted to flow from the voltage source 30 through the boost coil 22. The magnitude of boost current is controlled by regulating the time (i.e., boost pulse width) which current is permitted to flow. The regulation of current flow is performed by the adaptive pulse width boost circuit 40 which modifies the duration of the metering pulse to generate a boost pulse. Inasmuch as the boost coil 22 is an inductive device, it takes a finite time for the current to rise to its peak value. It can be shown that as the battery voltage increases, the rise rate of current will increase. The adaptive pulse width circuit 40 modifies the pulse width of the metering signal as the battery voltage varies. This feature attempts to hold the peak level of current between 10 and 12 amps, and yields satisfactory operation of each solenoid 21 at most voltage level conditions.

Figure 2:
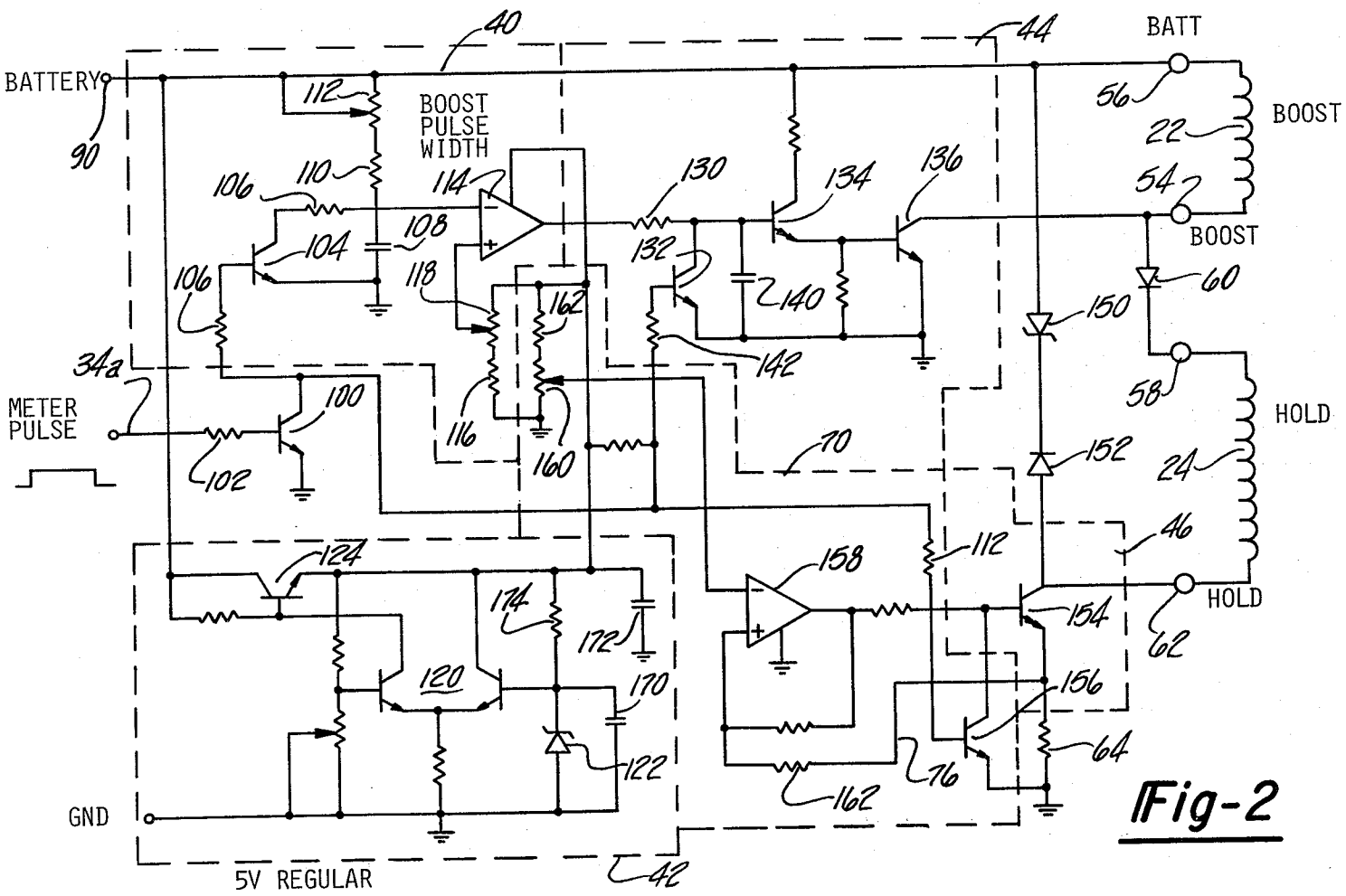
FIG. 2 is a circuit diagram illustrating features of the driver illustrated in FIG. 1.
Figure 5:
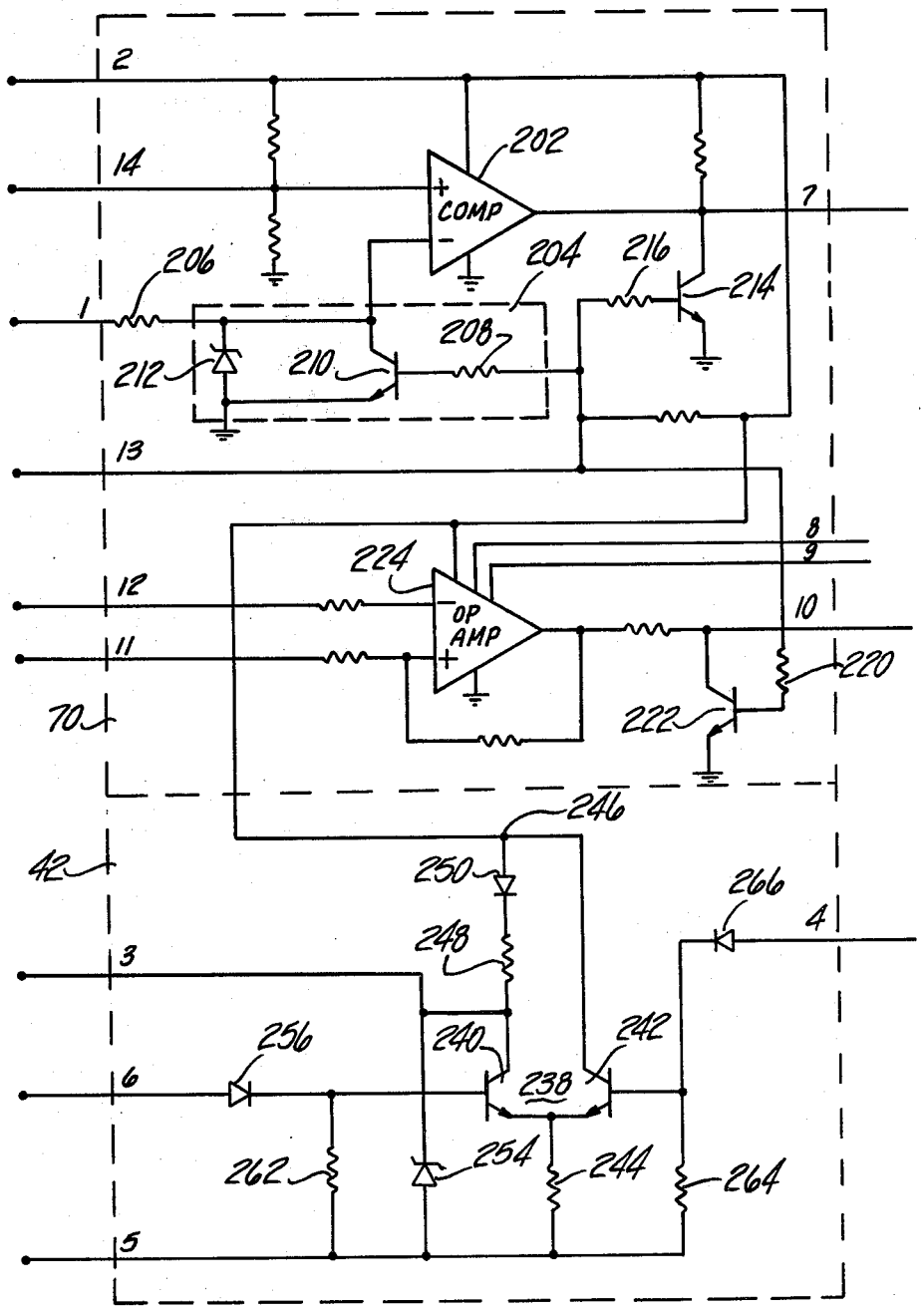
FIG. 5 is a circuit diagram illustrating the circuitry of a portion of FIG. 4.

Reference is now made to FIG. 2 which illustrates in detail, those features of the driver circuit of FIG. 1. More specifically, the metering pulse is received via line 34*a* and is communicated to the base of transistor 100 through the input resistor 102. The purpose of transistor 100 is to invert and buffer the received metering pulse. The transistor 100 comprises an emitter follower having its base terminal adapted to receive the metering pulse. The output or collector terminal of transistor 100 is connected to the boost pulse circuit 40 and to the feedback current control 70 and more specifically to transistor 156. The collector of the transistor 100 is connected to the base of the transistor 104 through the resistor 106. The emitter of the transistor 104 is grounded and the collector of the transistor 104 is connected to one terminal of the resistor 106. The other terminal of the resistor 106 is connected to one terminal of the capacitor 108, the other terminal of which is grounded and is also connected to the resistor 110, which is connected to one terminal of the potentiometer 112. The other terminal of potentiometer 112, as well as its center tap, is connected to the battery 90. The capacitor 108, the resistor 110 and the potentiometer 112 provide for the variable time constant which is used by the boost pulse width 40 to modify the duration of the metering pulse. The resistors 106 and 110 and the capacitor 108 are connected to the inverting input of a comparator 114. The threshold voltage value of the comparator 114 set by the series combination of the resistor 116 and the potentiometer 118. The center tap of the potentiometer 118 is connected to the non-inverting terminal of the comparator 114. The comparator 114 receives power from the voltage regulator 42. The voltage regulator 42 comprises a differential amplifier 120. The output of the differential amplifier 120 is connected to a zener diode 122 and to an NPN transistor 124. In the preferred embodiment, the zener diode is of the type which generates a 3.3 volt reference signal. Inasmuch as a common variety of NPN transistor 124 requires, as a minimum, approximately 1.5 volts across it to maintain a regulated five volt output voltage level, it can be seen that the voltage regulator 42 is not an optimum regulator for battery voltages below approximately 6.5 volts. An alternative embodiment of the regulator is illustrated in FIG. 5 and utilizes a PNP pass transistor to permit voltage regulation in situations when the battery voltage is at a level as low as 5.3 volts.

Returning now to the discussion of the comparator 114. The output of the comparator 114 corresponds to the output of the adaptive pulse width circuit 40 and is communicated via the resistor 130 to the emitter terminal of the transistor 132 and to the base terminal of the Darlington pair 134. The collector terminal of the Darlington pair 134 is appropriately biased relative to the battery 90. The output or emitter terminal of the Darlington pair 134 is connected to the base terminal of the driver transistor 136, the emitter of which is connected to the ground. A capacitor 140 is connected from the base terminal of the Darlington pair to the emitter of the transistor 132 which is at ground potential. The base terminal of the transistor 132 receives the inverted metering pulse via the resistor 142 from the output or collector of the transistor 100. The output of the transistor 136 is connected to the terminal 54 of the boost coil 22 and to the anode of the isolation diode 60. The terminal 56 of the boost coil 22 is connected in common to the battery 90 and to the anode of zener diode 150, the cathode of which is connected to the cathode of the blocking diode 152. The anode of the diode 152 is connected to the cathode of a second Darlington pair 154 and to the terminal 62 of the hold coil 24. The Darlington pair 154 comprise the driver 46 of FIG. 1. The emitter terminal of the Darlington pair 154 is connected to one terminal of the sense resistor 64, the other terminal of which is grounded and connected to the emitter terminal of transistor 156. The collector terminal of transistor 156 is connected to the base of the Darlington pair 154. As previously mentioned, the base of transistor 156 is connected to the transistor 100 via resistor 112 and receives the inverted metering signal. The collector of the transistor 156 and the base of the Darlington pair 154 are connected to the output of comparator 158, which is adapted to receive at an inverting terminal a threshold voltage set by the series combination of resistors 160 and 162. The non-inverting terminal of comparator 158 is connected via resistor 162 to the sense resistor 64.

The boost coil 22 is preferably a low resistance, low inductance coil which is connected via the isolation diode 60 to the hold coil 24. The hold coil may be a higher resistance coil having a higher inductance than the boost coil 22.

In operation the comparator 114 is activated upon receipt of a metering pulse which is transmitted from the electronic control unit 32 via line 34*a* to transistor 100. Transistor 100 conditions and inverts the metering pulse. A variable duration boost pulse is generated at the output of comparator 114 by the cooperation of capacitor 108 and resistors 110 and 112. The boost pulse signal generated in response to the metering pulse allows capacitor 108 to charge. The boost pulse will terminate when the threshold level established by resistors 116 and 118 is achieved. The metering pulse, the charging curve of capacitor 108 and the resulting boost pulse are illustrated in lines 1, 2 and 3 of FIG. 3. The boost pulse is communicated via the Darlington pair 134 to the boost drive transistor 136. In the preferred embodiment, the Darlington pair 134 is configured to have a minimum gain of 1,000, consequently, a current flow of one (1) ma will drive the transistor 136 into saturation, therein creating a boost current charging path from the battery 90 through the boost coil 22 and the transistor 136 to ground.

During the boost mode, the capacitor 140 charges so as to slow the transition between the boost mode and hold mode and functions to reduce current undershoot.

The Darlington pair 154 can be activated close to the end of the boost pulse to permit current to flow within the hold coil 24 or as discussed below activated simultaneously with the boost coil 22 by the metering pulse via the transistors 100 and 156. Inasmuch as the hold coil 24 has been chosen to have an inductance which is substantially larger than that of the boost coil 22, it can be shown that during the initial moments of operation, due to low voltage at the terminal 54 and the larger inductance of the hold coil 24, current will not flow therethrough, thus permitting the relatively simultaneous activation of the hold coil 24 and of the boost coil 22.

In addition, while the number of turns in either the boost coil 22 and the hold coil 24 may vary with the specific application, it has been found that for automotive fuel injectors, the total number of turns in both coils should be sufficient so as to require only a one ampere current. Upon the activation of the Darlington pair 154 and transistor 136, battery current and the current flowing within the boost coil 22 will be diverted through the isolation diode 60 and caused to flow through the hold coil 24 to ground through the sense resistor 64.

The current feedback control 70 and the hold driver 46 cooperate to maintain and to regulate the hold current at a fixed value. Resistors 160 and 162 are set to provide a reference hold voltage for comparator 158 to which the voltage generated by the current flowing through the senser resistor 64, is compared.

As previously mentioned during the boost and hold modes, the voltages produced by the inductive action of the coils 22 and 24 will be substantially greater than the nominal 12 volt battery voltage. The zener diode 150, which in this application has been chosen to be a 68 volt zener diode and the blocking diode 152 limit the voltage across both coils to approximately 80 to 90 volts after the boost driver circuit 44 is turned off. This controlled voltage level limits the strength of the magnetic field, allows for a quick decay of the magnetic field and serves to protect the Darlington pair 154 and the boost drive transistor 136 from a voltage breakdown condition.

Figure 3:
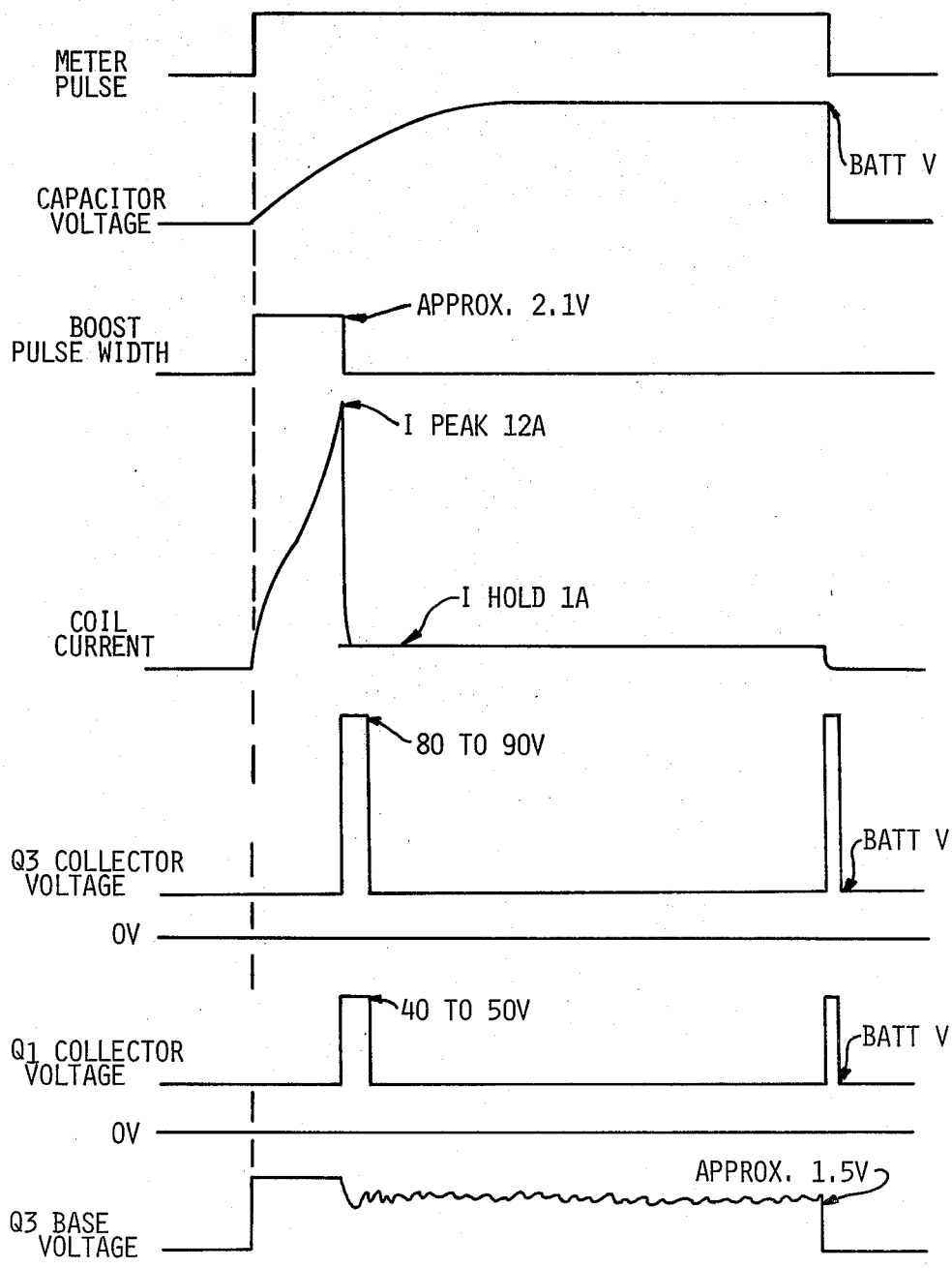
FIG. 3 graphically illustrates a number of the waveforms generated by the circuit shown in FIG. 2.

Reference is briefly made to FIG. 3, lines 4, 5, 6 and 7 which illustrate the current flowing through coils 22 and 24 the voltage appearing at the collector of the Darlington pair 154 (line 5), the voltage appearing at the collector of the drive transistor 136 (line 6) and the voltage at the base terminal of the Darlington pair 154 (line 7).

Figure 4:
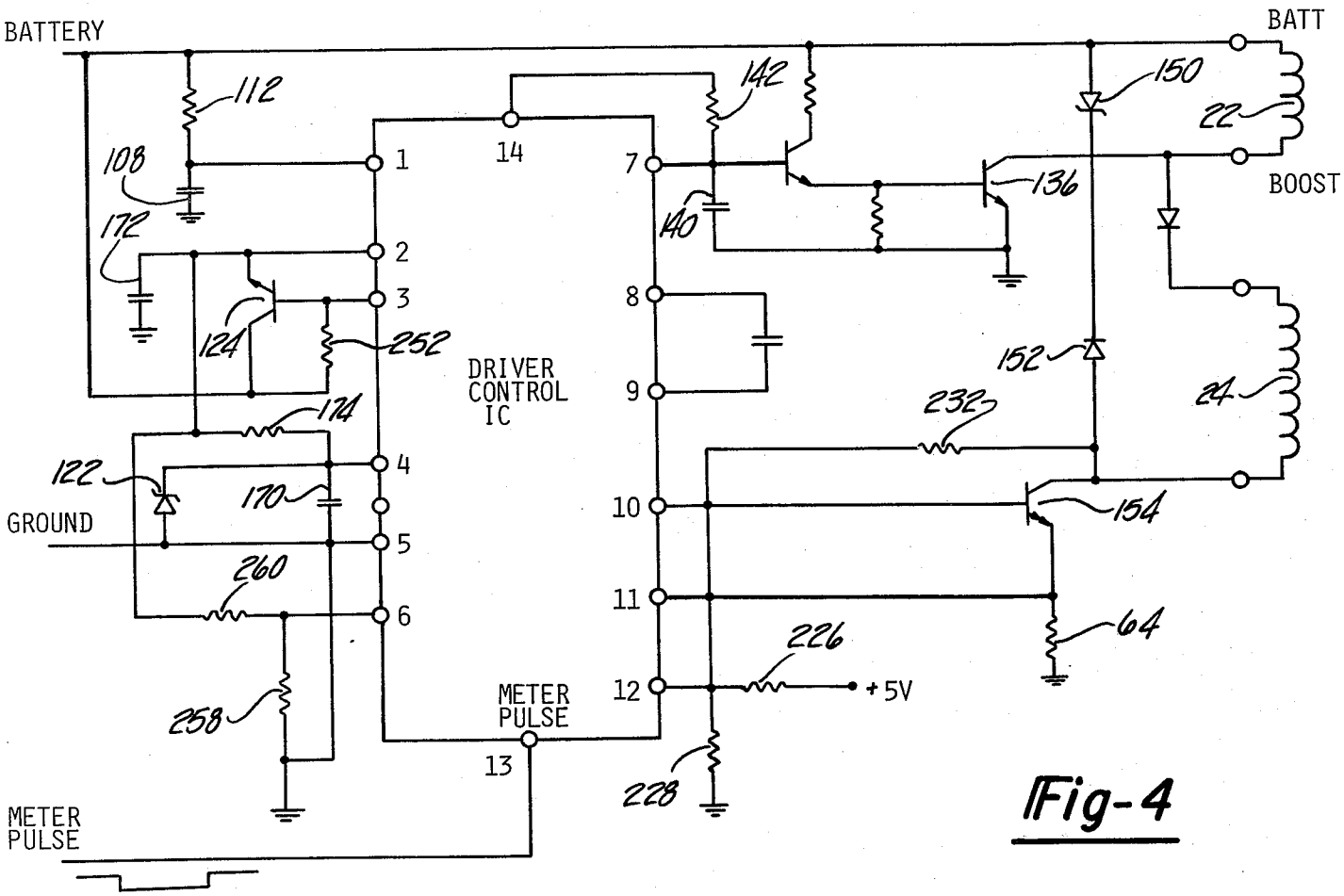
FIG. 4 is a partial block diagram illustrating an alternate embodiment of the invention.

Reference is now made to FIGS. 4 and 5, which illustrate an alternate driver circuit that is substantially similar to the circuit illustrated in FIG. 2. However, certain portions of the circuitry comprising the adaptive pulse width boost circuit 40, the voltage regulator 42 and miscellaneous control transistors have been included within an integrated circuit chip 200. The combination of resistor 112 and charging capacitor 108 cooperate, as before, to modify the duration of the input metering pulse to determine the duration of the boost pulse. The voltage appearing on capacitor 108 is communicated via pin 1 to the inverting terminal of comparator 202 (FIG. 5) through a capacitive discharge network 204 that comprises resistors 206, 208, the NPN transistor 210 and a zener diode 212 which is connected across the collector and emitter terminals of transistor 210. Transistor 210 of FIG. 5 is the equivalent to transistor 104 as illustrated in FIG. 2. The output of comparator 202 is connected to the collector of the NPN transistor 214, which has its emitter terminal grounded. The collector of the transistor 214 is also connected to the regulated voltage supply 42. The base terminal of the transistor 214 is connected to the base terminal of the transistor 210 through the resistor pair 208 and 216. The output or the cathode terminal of the transistor 214 is connected via pin number 7 of chip 200 to one terminal of capacitor 140 and to one terminal of resistor 142, the other terminal of which is connected via pin 14 to the non-inverting input terminal of comparator 202. The resistor 142 feeds back an opposite polarity signal to comparator 202 which, in turn, enhances its switching rate.

In the embodiment illustrated in FIGS. 4 and 5, the metering pulse employs negative logic. Consequently, during the interval of time when a metering pulse is not communicated via line 34*a* to pin 13, pin 13 is maintained at a positive voltage potential which, in turn, causes transistors 210 and 214 to be in a conductive state which shorts capacitor 108 to ground. When the metering pulse goes negative, i.e. to zero, transistors 210 and 214 are made non-conductive which, in turn, permits capacitor 108 to charge and causes the boost pulse to be generated and communicated via pin 7 to the boost driver circuit 44 and in particular, to the capacitor 140.

The metering pulse is also communicated from pin 13 of chip 200 through resistor 220 to the NPN transistor 222. The purpose of this additional transistor 222, which corresponds to transistor 156 of FIG. 2, is to inhibit of the operation of the Darlington pair when the metering signal is not correct. For example, if due to sone malfunction a positive voltage is applied to transistor 222 via resistor 220, then transistor 222 would terminate solenoid current, or if lines 32*a*–n from the electronic control unit 32 became open circuited then the transistor 222 would cause the driver to fail safe. The output or collector terminal of the transistor 222 is connected to pin 10, which is appropriately connected to the Darlington pair 154.

The input signals to the current feedback circuit 70 are derived from the feedback voltage which is transmitted via pin 11 to the non-inverting terminal of comparator 224 which has appropriate resistors for biasing and voltage gain generation. The reference level of comparator 224 is set by the external voltage divider network comprising resistors 226 and 228 which are connected to the output of the regulated five volt supply. The comparator 224 is stabilized by using the external capacitor 230 which is connected across pins 8 and 9.

The voltage at pin location 12 of chip 200 determines the voltage reference for comparator 224. During steady state operation, this voltage level is determined by the output of the voltage divider comprising resistor 226 and 228 and the five volt reference supply. The reference voltage may be modified by feeding back a portion of the voltage generated at the terminal 62 of the hold coil 24 via the resistor 232 to pin 12. By so modifying the reference voltage, which determines the desired level of current feedback, the current droop exhibited during the transition from the boost mode to the hold mode is substantially reduced.

Reference is now made to the voltage regulator 42, as illustrated in FIG. 5, which comprises the differential amplifier 238 comprising the matched NPN pair of the transistors 240 and 242 which have their emitter terminals coupled together and connected to ground via the resistor 244. The collector terminal of the transistor 242 is connected to circuit node 246. The collector of the transistor 240 is connected to node 246 through the series combination of resistor 248 and diode 250. The collector of the transistor 240 is connected via pin 3 to the base of the external transistor 124 of FIG. 4. In addition, the resistor 252 is connected in parallel between the base and collector terminals of transistor 124. The collector of the transistor 124 is connected to the battery. A capacitor 172 is connected from the emitter terminal of the transistor 124 to ground and to one terminal of the resistor 174. The other terminal of resistor 174 is connected to pin 4, the cathode of the zener diode 122 and to one terminal of the capacitor 170. The anode of diode 122 and the other terminal of the capacitor 170 are grounded. The transistor 124 provides the controlling means for developing the regulated 5.0 volt signal for the voltage regulator 42.

Figure 6:
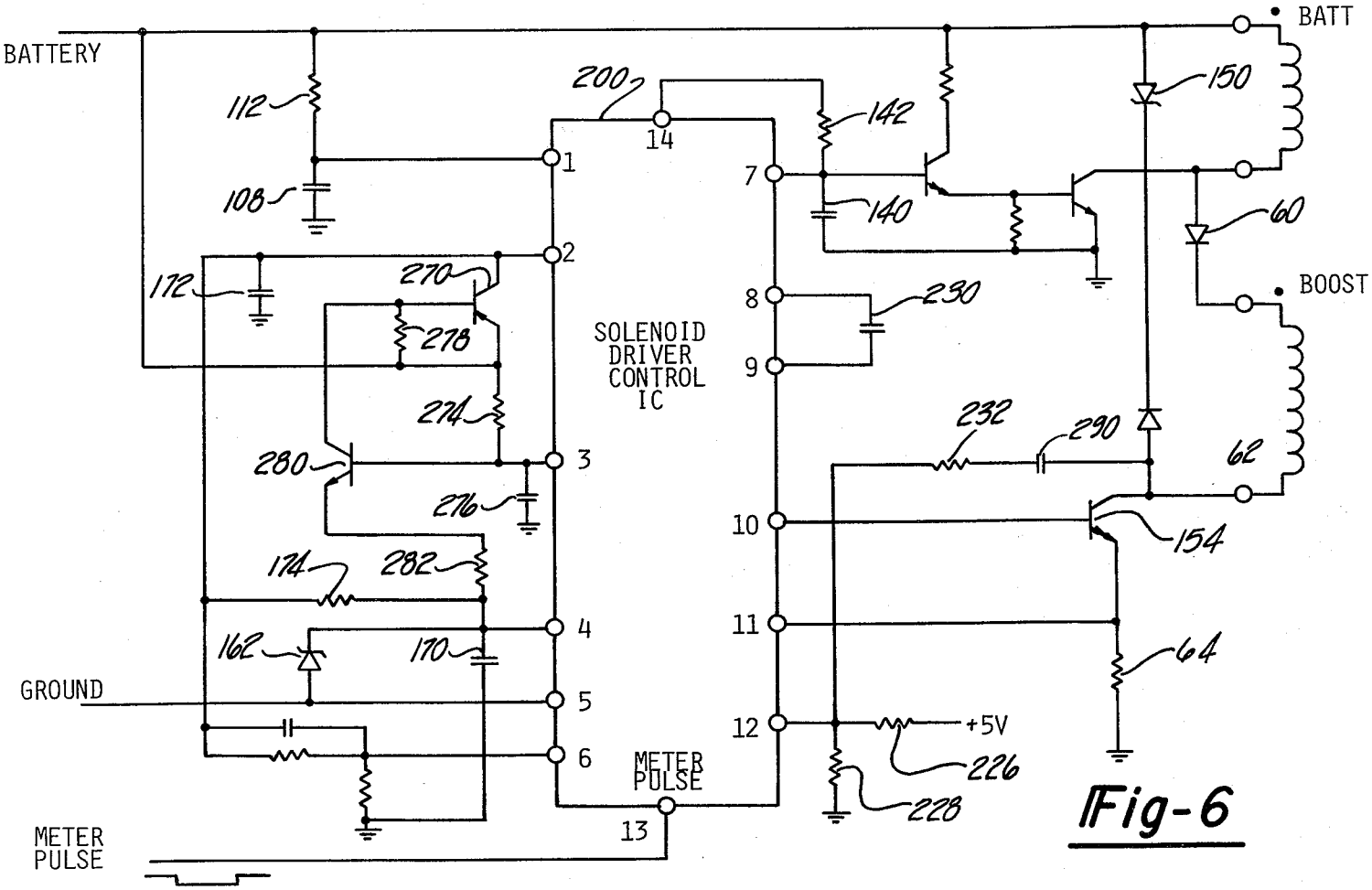
FIG. 6 illustrates another embodiment of the driver circuit.

The 5 volt voltage regulator portion of the integrated circuit chip 200 will function with either the NPN transistor 124 or the PNP transistor 270 (see FIG. 6). The diode 250 permits proper voltage regulation when using the PNP pass transistor 270 configuration and allows sufficient current from resistor 274 to turn on transistor 280 by blocking a current path to the 5.0 volt bus (pin 2) which is at a low voltage prior to coil activation.

The major amount of current to transistor 240 is supplied via the diode 250 and resistor 248. Resistor 248 is needed to supply a source of current to "turn on" transistor 124 that is connected to pin 3. Capacitor 172 acts as a filter to further stabilize the 5.0 volt supply. The collector of transistor 240 is also connected to ground via the zener diode 254. The zener diodes 254 and 256 are used with the integrated circuit chip 200 to protect the substrate from high voltage transients. These zener diodes 254 and 256 are connected to corresponding circuit locations which could experience voltages in excess of 20 volts via a current path from the battery. The base terminal of transistor 240 is connected to the cathode of the diode 256, the anode of which is connected via pin 6 to the voltage divider network consisting of the resistors 258 and 260 (see FIG. 4). The voltage divider network generates a biased sense voltage which is a function of the reference voltage generated at pin 4. The cathode of the diode 256 is connected to ground via the resistor 262. The base of the transistor 242 is connected to ground via the resistor 264 and to the external capacitor 170 and the zener diode 122 combination via the diode 266.

Reference is briefly made to FIG. 6 which illustrates an alternate driver circuit. The circuit illustrated in FIG. 6 is substantially identical to that illustrated in FIG. 4, with the major exception that the NPN transistor 124 has been replaced by the PNP pass transistor 270. More particularly, the collector terminal of the transistor 270 is connected to pin 2 of chip 200 and to the external capacitor 172. The emitter terminal of the transistor 270 is connected to the battery and to one terminal of resistor 274, the other terminal of which is connected to one terminal of external capacitor 276 and to the voltage regulator via pin 3 of chip 200. The emitter terminal and base terminals of the transistor 270 are connected by resistor 278. The base terminal of the transistor 270 is further connected to the collector terminal of the transistor 280, the base of which is connected in common to resistor 274, 276 and pin 3. The emitter terminal of transistor 280 is connected via the resistor 282 to the junction of the resistor 174 which is in common with zener diode 162, capacitor 170 and pin 4. In addition, as previously mentioned, a portion of the voltage produced by transformer action is used to modify the reference voltage established by the 5 volt source and resistors 226 and 228. This modification is accomplished by connecting the series combination of resistor 232 and capacitor 290 between terminal 62 of the hold coil 24 and the common mode of resistor 226 and 228. The resistor 232 and the capacitor 290 create a circuit condition wherein the transition between the boost and hold modes is smoothed thus substantially eliminating any current droop or undershoot. Alternatively, capacitor 290 could be eliminated, however, the level of hold current might then be effected by the battery 90 voltage level.

Many changes and modifications in the above described embodiments of the invention can of course be carried out without departing from the scope thereof. Accordingly that scope is intended to be limited only by the scope of the appended claims.

Having thus described the invention, what is claimed is:

1. A driver circuit for a fuel injector, the driver circuit adapted to be connected to a voltage source and to receive input metering signals from an electronic control unit, for controlling the operation of a solenoid of the type having a plurality of coils situated so as to produce, when activated, aiding magnetic fields, the driver circuit comprising:

voltage regulator means connected to said voltage source for generating a regulated voltage;

adaptive means, responsive to the metering signals for generating a pulse width boost signal that is variable in correspondence with fluctuations of the voltage level of said voltage source;

first driver means, responsive to said boost signal, and connected to the first of said coils for causing current to flow therethrough;

second driver means, responsive to said boost signal, and connected to the second of said coils for activating said second coil and for causing the current flowing through said first coil to flow through said second coil; and first means connected to said first or said second driver means for reducing current droop upon activation of said second coil.

2. The driver circuit as defined in claim 1 further including means for regulating the level of current flowing through said second coil.

3. The driver circuit as defined in claim 2 wherein said first means includes second means for feeding back a portion of the voltage generated by either of said coils to said voltage regulator means.

4. The driver circuit as defined in claim 3 wherein said second means comprises a resistor-capacitor combination connected between one terminal of said second coil and said voltage regulator means.

5. The driver circuit as defined in claim 4 wherein said second coil has an inductance greater than that of said first coil.

6. The driver circuit as defined in claim 5 wherein said first and said second coils are activated substantially at the same time.

7. The driver circuit as defined in claim 6 wherein said adaptive means comprises:

a comparator (98) having a determinative threshold voltage output level; and variable voltage generating means (92, 94, 96) connected to said voltage source and said comparator for generating a voltage indicative of the voltage level of said voltage source.

8. The driver circuit as defined in claim 7 wherein said last named means comprises a resistor-capacitor network.

9. The driver circuit as defined in claim 8 wherein said comparator comprises a positive feedback loop.

10. The driver circuit as recited in claims 1 or 7 wherein said voltage regulator means further comprises first and second NPN transistors (240, 242) connected to ground potential via a first resistor (244);

a first diode having is anode connected to the collector terminal of said second transistor (242) and having its base terminal connected to the collector of said first transistor (240) via a second resistor (248);

a zener diode (254) having its anode terminal connected to the collector terminal of said first transistor (240) and its cathode terminal connected to ground potential;

a third resistor (262) connected between the base terminal of said first transistor (240) and ground potential;

a fourth resistor (264) connected between the base terminal of said second transistor (242) and ground potential;

a second diode (256) having its cathode terminal connected to the base terminal of said first transistor; and a third diode (266) having its cathode terminal connected to the base terminal of said second transistor.

11. The driver circuit as defined in claim 10 further including:

a third NPN transistor (124) having its emitter terminal connected to the anode terminal of said first diode (250) and its base connected to the collector of said first transistor and wherein the emitter terminal is connected to one terminal of a second capacitor (172) the other terminal of which is grounded;

a fifth resistor (252) connecting the collector terminal to the emitter terminal of said third transistor (124), and wherein the collector terminal of said third transistor (124) is connected to said voltage supply;

a sixth resistor (174) having one terminal connected to the emitter terminal of said third transistor (124) and to the anode terminal of said second diode (256) and having its other terminal connected via capacitor (170) to ground potential and to the anode of said third diode (266); and a zener diode (122) connected between the anode of said third diode (266) and ground potential.

12. The driver circuit as defined in claim 11 wherein said one terminal of said sixth resistor (174) is connected to the anode of said second diode (256) by a voltage divider circuit comprising resistor 260 interposing said one terminal and the anode of said second diode and resistor 258 connecting the anode of said second diode to ground potential.

13. The driver as defined in claim 10 further including:

a first PNP transistor (270) having its collector connected to the anode of said first diode (250) and having its emitter connected via a fifth resistor (274) to the collector of said first transistor (240) and to said voltage supply and further having its collector connected to the anode of said second diode (256);

a sixth resistor (278) interconnecting the base and emitter of said first PNP transistor (270);

a third NPN transistor (280) having its collector connected to the base of said first PNP transistor (270) its base connected to the collector of said first transistor (240) and further having its emitter connected via seventh resistor (282) to the anode of said third diode (266);

an eighth resistor (174) having one terminal connected to the anode of said third diode (266) and having its other terminal connected to the emitter of first PNP transistor (270); and a zener diode (162) connected between the anode of said third diode (266) and ground potential.

14. A driver system responsive to metering pulses for fuel injectors comprising:

a voltage source (90);

voltage regulator means (42) connected to said voltage source for generating a regulated voltage;

a boost coil (22) having one terminal connected to said voltage source and a second terminal;

a hold coil (24) having one terminal connected to the second terminal of said boost coil and having a second terminal;

an isolation diode (60) connected between the second terminal of said boost coil and the first terminal of said hold coil, a sense resistor;

hold coil driver means, including a first Darlington pair (154) having its output or collector terminal connected to the second terminal of said hold coil and having its emitter terminal connected to ground through said sense resistor and further having an input or base terminal;

regulator means (70, 156) for regulating the level of current flowing through said sense resistor comprising:

a feedback voltage regulator (224) responsive to the voltage across said sense resistor and having an output connected to the base terminal of said hold coil driver means;

a first NPN transistor (222), adapted to receive the metering pulse at its base terminal, and having its collector connected to the base of said first Darlington pair and further having its emitter terminal grounded;

first means (232) connected between the second terminal of said second coil and said feedback voltage regulator for reducing current droop upon the activation of said second coil;

adaptive means (40, 210, 202) responsive to the metering signals for generating a boost signal having a pulse width that is variable in correspondence width the fluctuations of the voltage level of said voltage source; and boost coil driver means (44) responsive to the output of said adaptive means and the metering pulse for causing current to flow through said boost coil.

15. The system as defined in claim 14 wherein said adaptive means comprises:

a comparator (202) having connected to its non-inverting input terminal to a threshold setting network;

variable voltage generating means (108,112) including a resistor (112) having one terminal connected to said voltage source and having its other terminal connected to one terminal of a capacitor (108) the other terminal of which is grounded and wherein the one terminal of said capacitor is connected to an inverting input terminal of said comparator;

capacitor discharge means, responsive to the metering pulses comprising:

a zener diode having its cathode connected to the one terminal of said capacitor and its anode terminal grounded; and a first transistor (210) adapted to receive the metering pulse at its base terminal, and having its collector-emitter path connected across said zener diode and wherein said base terminal is connected to the output of said voltage regulator means.

16. The system as defined in claim 15 wherein said first transistor (210) is an NPN transistor.

17. The system as defined in claims 14 or 16 wherein said boost coil driver means comprises:

a second NPN transistor (214) adapted to receive the metering pulse at its base terminal and wherein the base terminal is connected to the output of said voltage regulator means;

a second capacitor (140) having one terminal connected to the collector of said second NPN transistor and having its other terminal grounded;

buffer means for buffering the output of said second NPN transistor; and driver means, connected to the second terminal of said boost coil, responsive to the output of said buffer means, for permitting current to flow within said boost coil.

18. The system as defined in claim 17 wherein said buffer means includes a second Darlington pair having its collector connected to said voltage source and its base terminal connected to the one terminal of said second capacitor and wherein said second capacitor and wherein said driver means includes an NPN transistor (136) having its base connected to the emitter of said second Darlington pair, its collector connected to the second terminal of said boost coil and its emitter terminal grounded.

19. The driver circuit as recited in claim 18 wherein said voltage regulator means further comprises:

first and second NPN transistors (240, 242) connected to ground potential via a first resistor (244);

a first diode having is anode connected to the collector terminal of said second transistor (242) and having its base terminal connected to the collector of said first transistor (240) via a second resistor (248);

a zener diode (254) having its anode terminal connected to the collector terminal of said first transistor (240) and its cathode terminal connected to ground potential;

a third resistor (262) connected between the base terminal of said first transistor (240) and ground potential;

a fourth resistor (264) connected between the base terminal of said second transistor (242) and ground potential;

a second diode (256) having its cathode terminal connected to the base terminal of said first transistor; and a third diode (266) having its cathode terminal connected to the base terminal of said second transistor.

20. The driver circuit as defined in claim 19 further including:

a third NPN transistor (124) having its emitter terminal connected to the anode terminal of said first diode (250) and its base connected to the collector of said first transistor and wherein the emitter terminal is connected to one terminal of a second capacitor (172) the other terminal of which is grounded;

a fifth resistor (252) connecting the collector terminal to the emitter terminal of said third transistor (124), and wherein;

the collector terminal of said third transistor (124) is connected to said voltage supply;

a sixth resistor (174) having one terminal connected to the emitter terminal of said third transistor (124) and to the anode terminal of said second diode (256) and having its other terminal connected via capacitor (170) to ground potential and to the anode of said third diode (266); and a zener diode (122) connected between the anode of said third diode (266) and ground potential.

21. The driver circuit as defined in claim 20 wherein said one terminal of said sixth resistor (174) is connected to the anode of said second diode (256) by a voltage divider circuit comprising resistor 260 interposing said one terminal and the anode of said second diode and resistor 258 connecting the anode of said second diode to ground potential.

22. The driver as defined in claim 19 further including:

a first PNP transistor (270) having its collector connected to the anode of said first diode (250) and having its emitter connected via a fifth resistor (274) to the collector of said first transistor (240) and to said voltage supply and further havings its collector connected to the anode of said second diode (256);

a sixth resistor (278) interconnecting the base and emitter of said first PNP transistor (270);

a third NPN transistor (280) havings its collector connected to the base of said first PNP transistor (270) its base connected to the collector of said first transistor (240) and further havings its emitter connected via a seventh resistor (282) to the anode of said third diode (266);

an eighth resistor (174) having one terminal connected to the anode of said third diode (266) and havings its other terminal connected to the emitter of first PNP transistor (270); and a zener diode (162) connected between the anode of said third diode (266) and ground potential.

* * * * *